United States Patent [19]

Ljungkvist et al.

[11] Patent Number: 4,950,434

[45] Date of Patent: Aug. 21, 1990

[54] ARRANGEMENT FOR THE PRODUCTION OF LONGITUDINAL SCREED SLABS CONSISTING OF CONCRETE

[75] Inventors: Stig-Åke Ljungkvist, Skövde; Lennart Johansson, Mariestad, both of Sweden

[73] Assignee: Permaban Southeast, Inc., Matthews, N.C.

[21] Appl. No.: 11,396

[22] Filed: Feb. 5, 1987

Related U.S. Application Data

[63] Continuation of Ser. No. 728,175, Apr. 29, 1985, abandoned, which is a continuation of Ser. No. 488,403, Mar. 16, 1983, abandoned.

[51] Int. Cl.[5] ..... B28B 7/24

[52] U.S. Cl. ..... 249/50; 249/119; 249/125; 249/129; 264/297.9

[58] Field of Search ..... 249/28, 50, 119, 129, 249/125, 131; 264/297.9; 425/111

[56] References Cited

U.S. PATENT DOCUMENTS

| | | | |
|---|---|---|---|
| 2,725,611 | 12/1955 | Wissinger | 249/119 |
| 2,883,728 | 4/1959 | Sederlund | 249/50 |

FOREIGN PATENT DOCUMENTS

| | | | |
|---|---|---|---|
| 56943 | 10/1952 | France | 52/577 |
| 2285223 | 4/1976 | France | 249/50 |
| 1403985 | 8/1975 | United Kingdom | 249/184 |
| 83/00177 | 1/1983 | World Int. Prop. O. | 249/50 |

OTHER PUBLICATIONS

U.S. Patent and Trademark Office, Classification Definitions, Static Molds, Feb. 1975, Section II: Glossary.

*Primary Examiner*—James C. Housel
*Attorney, Agent, or Firm*—Allegretti & Witcoff, Ltd.

[57] ABSTRACT

An arrangement for casting in a mould of so-called battery design longitudinal concrete bodies with a high degree of linearity. The moulds consist of pipes of substantially circular cross-section, these being placed on top of beams which, within a frame, extend parallel to the longitudinal sides of the frame. The beams constitute lower casting boundaries in the process of casting and each two adjacent pipes constitute two lateral boundary sides in the process of casting. The underside of each mould pipe is levelled and provided with a longitudinal rail of upside-down T-shape, which is cut out at several points and at mutually identical distances. A plurality of plates each with a Y-shaped recess are placed between the top edges of the beams and at the same distances as the cut out rails. The recess matches the leg of the T-rail, and pipes are rigidly secured atop the beams by joined T-rails and plates.

4 Claims, 1 Drawing Sheet

FIG. 1
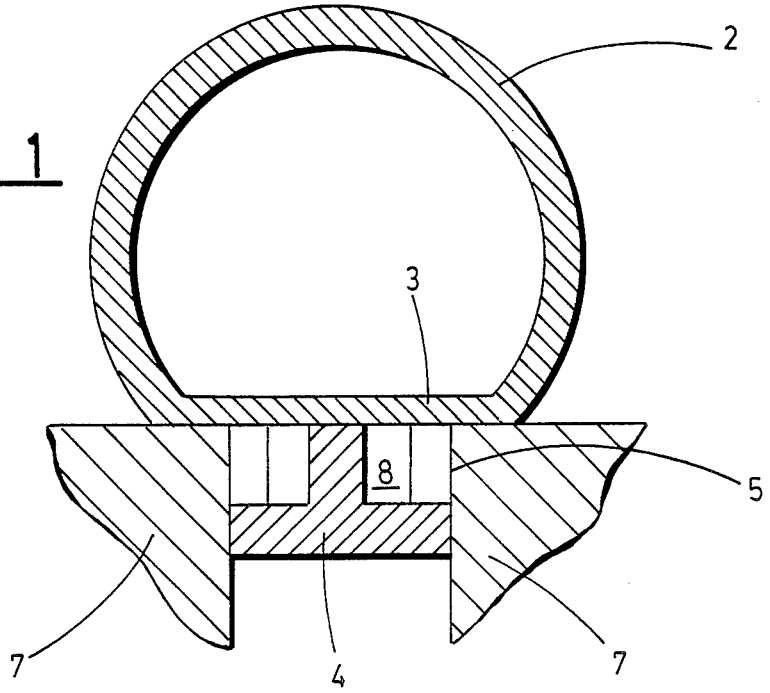
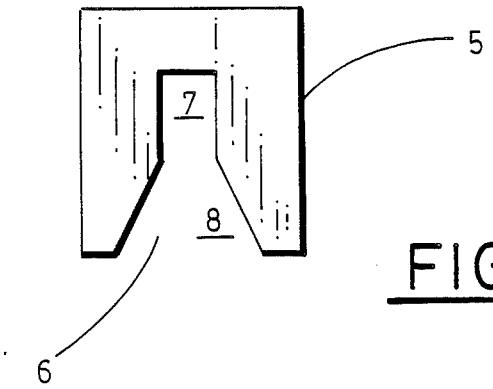
FIG. 2

ARRANGEMENT FOR THE PRODUCTION OF LONGITUDINAL SCREED SLABS CONSISTING OF CONCRETE

This application is a continuation of application Ser. No. 728,175, filed Apr. 29, 1985, abandoned, which is a continuation of application Ser. No. 488,403, filed Mar. 16, 1983, abandoned.

BACKGROUND OF THE INVENTION

This invention relates to an arrangement for the production of longitudinal screed slabs consisting of concrete.

PCT publication WO 81/02600 published Sept. 17, 1981 describes a method for producing concrete floors of high quality as regards planeness and rational construction. With this invention use is made of slide tracks for the vibrating beams employed in the process of producing the floor, by way of permanent moulds. By providing the slabs with either holes or both holes and brackets continuous reinforcement can be achieved, which means that shrinkage cracks do not arise in the floor along these slabs.

In producing these slabs a number of problems have been encountered, all of which could be solved with the aid of generally known technology (e.g. concrete grades suitable for the hard wear). One problem, however, has proved to be of considerably greater complexity. It relates to the fact that when casting the slabs, which is done in so-called battery moulds, the slabs must be linear. The difficulty consists partly in the fact that it is difficult to produce moulds of sufficient linearity and in that after repeated use the moulds developed a nonlinear shape due to handling. The present invention proposes an arrangement enabling production with the aid of cheap moulds suitable for imparting good linearity to the slabs.

Moulds can be produced from thin metal sheeting bent to the required cross-sectional shape. The sections are then connected by point-welding. This gives rise to heat stresses causing deformation of the sheets with disastrous consequences for the use of the resulting slabs. Also injection-moulded aluminium has been tried but after handling the condition of this product became quite bad. Once this was the case it was less possible to produce correct slabs. In addition aluminium is, after all, subject to the disadvantage that it is attacked by concrete, so that the surface of the product becomes rough.

SUMMARY OF THE INVENTION

It has proved possible to produce good quality slabs, by the so-called battery process. The latter is characterised in that several slabs are simultaneously produced in a large mould. As a result the moulding costs and the moulding work are reduced. However there is still the problem of making these slabs linear. This has been solved in accordance with the invention by shaping the slabs with the aid of parallel pipes close to one another. In the mould the outer sides of these pipes become the lateral boundary surfaces for the concrete. By placing these pipes on a bed of beams, one also achieves, owing to the beams, a lower boundary surface. The bed of beams consists of a frame of strong beams, whereby the length of the frame may amount to 5–10 meters and the width to 1–2 meters. The choice may be made entirely according to the capacity of lifting devices at the place of work (trucks or overhead cranes). Within the frames beams extend at equal distances, i.e. parallel to the longitudinal sides. The pipes are then placed in such a way that the beams constitute the underside of the mould. The invention now aims at an arrangement by which the pipes are secured and aligned in such a way that the linearity of the pipes is at least as good as that of the beams. As regards the pipes, the cross-section of which is nearly circular, that part of the periphery which is to form the base is levelled somewhat. This levelling operation is effected between 30–90 degrees of the centre angle. At the centre of this levelled face a rail is fixed which consists in an upside-down T. However, this continuity of the rail is broken by gaps at equal distances. These breaks occur e.g. at a rate of one per meter and with a length of 5 cm. This can be varied within wide limits, and the dimensions given at this point are mentioned only to facilitate comprehension of the function. Plates are placed on the bed of beams and between the beams, at the same distances as the breaks in the rails. The top edges of the plates are located edge in edge with the top edges of the beams. The plates are provided with a Y-shaped recess with the opening so arranged that the web of the T-shaped rail fits inside the Y-shaped recess. The expanding part of the Y-shapes is used for controlling the rail, in case non-linearities in the pipe may have prevented simple insertion.

BRIEF DESCRIPTION OF THE DRAWING

FIG. 1 is a partial, cross-sectional view of the preferred embodiment of the invention, sectioned vertically; and FIG. 2 is a plan view of a representative plate of the preferred embodiment.

DETAILED DESCRIPTION OF THE PREFERRED EMBODIMENT

FIG. 1 shows a cross-section illustrating the function of the above-named rail and the recessed-plate. (1) are two adjacent beams. On top of these beams is located a pipe (2) with a levelled part of the periphery (3). Attached to this pipe can be seen the T-rail (4) which, subject to certain breaks, extends along the pipe (2). The plate (5) is provided with a Y-shaped recess (6) subdivided into the inner section (7) and the expanding outer section (8). FIG. 2 shows the plate by itself in a different projection, use being made of the same reference numbers as in the previous case.

It is of course most important that the bed of beams is made of strong beams and that the planeness is accurately adjusted. The entire bed of beams is then placed on three or several bearing brackets which in turn are provided with vibration-generating devices, all with a view to ensuring satisfactory casting.

We claim:

1. Casting apparatus for casting concrete bodies comprising:

a frame having a plurality of beams within the frame, the beams extending parallel to each other and having top edges;

each top edge providing a lower boundary;

a plurality of elongated pipes each of which has an underside and sides, each said providing a lateral boundary;

a plurality of elongated T-rails, each T-rail joined and extending along an underside of a pipe, having a web, and defining a plurality of spaced T-rail gaps; and a plurality of plates, one for each T-rail gap, each plate having a recess for a T-rail web for securing the T-rail to the plate, and each plate joined to two adjacent beams between the top edges of the adjacent beams;

each pipe being releasably mounted by T-rails and corresponding plates to the beams whereby the pipes are held to a high degree of linearity on the beams and the concrete bodies cast against the lower and lateral boundaries also have a high degree of linearity.

2. Casting apparatus as in claim 1 in which each beam top edge is planar and in a plane with all beam top edges, in which each pipe underside is levelled, and in which each levelled pipe underside partially rests on two adjacent beam top edges.

3. Casting apparatus as in claim 1 in which each plate has recess sidewalls along the recess including an expanding portion for controlling insertion of the T-rail web into the recess.

4. Coating apparatus as in claim 1 in which each T-rail web has a width in a direction perpendicular to the beams and parallel to the beam top edges and a height in a direction perpendicular to the beams and perpendicular to the beam top edges, each plate having recess sidewalls along the recess including a rectangular portion with a width substantially equal to the T-rail web width and a height substantially equal to the T-rail web height, whereby the pipes are mounted to the beams securely in both the direction of the heights and the direction of the widths.

* * * * *